United States Patent [19]

Weber

[11] Patent Number: 4,995,415

[45] Date of Patent: Feb. 26, 1991

[54] PARTIALLY FLOODED GAS APPLIANCE SAFETY SHUT-OFF METHOD AND APPARATUS

[76] Inventor: Harold J. Weber, 313 Washington St., Holliston, Mass. 01746

[21] Appl. No.: 320,998

[22] Filed: Mar. 9, 1989

[51] Int. Cl.[5] ..... F16K 17/36; F22B 37/46

[52] U.S. Cl. ..... 137/1; 122/507; 137/65; 137/66; 137/78.5

[58] Field of Search ..... 137/65, 78.4, 405, 66, 137/312, 558, 1; 122/507, 504, 13 R, 14; 126/351, 361; 431/18

[56] References Cited

U.S. PATENT DOCUMENTS

| | | | |
|---|---|---|---|
| 2,192,858 | 3/1940 | Peterson | 137/80 |
| 2,592,863 | 4/1952 | Conner | 122/13 R |
| 2,841,170 | 7/1958 | Kalsey | 137/410 |
| 3,473,553 | 10/1969 | Collins | 137/312 |
| 3,801,064 | 4/1974 | Harris | 137/65 X |
| 4,572,113 | 2/1986 | Baughman | 122/507 X |
| 4,796,658 | 1/1989 | Caple | 137/558 X |
| 4,805,662 | 2/1989 | Moody | 122/507 X |

FOREIGN PATENT DOCUMENTS 2606656 8/1977 Fed. Rep. of Germany ..... 137/312

*Primary Examiner*—Stephen M. Hepperle

[57] ABSTRACT

Gas burner safety device for use with gas fired heating systems and water heaters to shut-off main gas valve controlled gas flow to the burner's main gas jet in the event that the main jet becomes partially submerged to at least a critical level in surrounding floodwater and unable to function normally, although the burner's pilot light remains lit and unimpeded resulting in generation of a erroneous thermocouple safety interlock signal for the main gas valve. The device prevents any massive injection of gas into the surrounding floodwater as gas bubbles which can float about and uncontrollably ignite, or release of gas into the circumjacent environment, thereby preventing an otherwise very dangerous situation where fire or explosion may occur which might result in extensive property damage, as well as personal injury or death.

20 Claims, 9 Drawing Sheets

PARTIALLY FLOODED GAS APPLIANCE SAFETY SHUT-OFF METHOD AND APPARATUS

FIELD OF INVENTION

My invention relates generally to the field of gas operated appliances, and most particularly to safety devices for use with domestic gas operated boilers, furnaces and hot water heaters.

In particular, my invention relates to the improved design of new manufacture gas burners and retrofit of pre-existing gas burners like those widely used in domestic and commercial heating systems and hot water heaters in order to prevent considerable property damage and personal injury due to fire or explosion which results from minor flooding of a basement or other confined area where the gas operated equipment may be installed.

BACKGROUND OF INVENTION

Unexpected partial flooding of basements has been observed to lead to a peculiar accident causing situation where considerable damage to several different heating system boilers is known to have occured. More importantly, the set of conditions which causes the problem is not of isolated or exceptional origin, because these conditions have repeatedly taken place in different settings with widely different kinds of gas-fired heating systems. In one incident, the fire department was summoned by tenants of an apartment building and the firemen encountered "fire popping up all over the place", meaning on the surface of the water which had flooded the basement as the result of heavy downpour rain. In addition, the heating system wiring (particularly the low-voltage thermostat wiring) was heavily damaged and the plastic knob and other parts on the combination gas valve/-regulator body had melted. The fire department appeared to have no idea of what had gone wrong, and they merely concluded that the hot-water (hydronic) boiler had broken down. In another occurrence involving a different location and a steam-boiler of totally different design the same mysterious failing again took place. Just as in the previous situation, the gas valve was destroyed by intense heat where all the plastic parts had melted and the wires connected to it were charred. Again, and to my surprise, no one from the gas utility company (who was called to repair it) appeared to have any idea whatsoever of what had gone wrong: just that the basement had flooded and as a result the gas valve has "failed" and needed replacement.

Upon more careful examination and subsequent evaluation of the setting for each of these unsual failures, the common thread which has been discovered is that the water level which was observed to have been flooding each of the heating system boiler areas had been relatively shallow, on the order of 4 to 6 inches or so. I have since determined that what appears to take place is that natural gas is injected directly into the water in the form of gas bubbles which will then surface and ignite, either from being near the gas burner's pilot flame, or from one-another (like a "row of dominos"). This scenario is obviously the setting for a very dangerous situation, because the burning gas bubbles can at best merely damage the boiler and its controls, but worse they may ignite nearby flammable material or trash.

What I further discovered is that when the water floods and submerges the heating system's gas burner to a certain (albeit unexceptional) CRITICAL LEVEL, which happens to be typically on the order of 4 to 6 inches or so, the depth of the water is just sufficient to obstruct the main jets on the gas burner, while the pilot light and the associated thermocouple is ordinarily placed a little higher and keeps on operating as though nothing is wrong. This critical level for the floodwater establishes a set of conditions which uniquely combine to fool and thus defeat the usual safety provisions inherent of the modern gas valve used on the gas burner, because the still heated thermocouple continues to produce an interlock signal indicating that all of the operating conditions are proper, while in reality the actual operating conditions are not. As a result of this false thermocouple produced interlock signal condition, the main jets will be able to turn ON and massive amounts of gas will inject directly into the water as gas bubbles. Of course, if the water becomes deeper than the critical level the pilot light will also be snuffed out allowing the thermocouple to cool and a loss of the interlock signal, and the main gas valve can not open as provided for with the usual safety precautions included by most, if not all, gas valve manufacturers. Unfortunately the water level invariably has to pass through the certain critical level where false operation of the burner occurs if the heating system or hot water heater calls for "more heat". This condition is of course more exacerbated in cold weather or during certain portions of the day when main burner operation is likely to be more frequent.

I find that it is the surfacing gas bubbles which lead to the peculiar distruction of the burner's gas valves and wiring. If a typical gas burner setup such as commonly found in a boiler or furnace is investigated, it is usual that the main gas jets are quite near (and often under) the gas valve. It is also usual practice that the main gas jets are sited substantially lower than the location of the pilot light and thermocouple. As a result, any gas which becomes injected into the water may surface under or very near the valve and where it can be ingnited by the still-burning pilot flame. Obviously much damage will result from such a situation. It is also possible that, if the gas bubbles are to drift some distance away from the gas burner before they surface and ignite, the even more dangerous possibility is present for further igniting of nearby inflammable trash or other objects. A worst-case scenario is that of where the raw gas accumulates in the confined area of a basement or boiler room and is then suddenly ignited by the still-present pilot light flame with the result being a massive explosion or building fire.

The current design and manufacture method of modern gas burners used in boilers and furnaces is a clearly defined area of at least engineering oversight, if not outright product negligence. It is probably unknown just how many fires, explosions, and deaths occur each year due to the synergistic effect of shallow flooding of a basement causing partial gas burner flooding to a critical level which leads to failure of the usual safety provisions of a conventional gas burner. For the most part, in the event of severe fire or explosion, the cause may be written-off as due to unknown causes. Product negligence results because popular and well-known manufacturers of gas-fired major appliances such as furnaces and boilers continue to make and sell huge quantities of equipment which does not provide any shut-down provision for the gas burner apparatus in the event of partial flooding such as I have observed to occur. Moreover these same manufacturers do not provide for any aftermarket retrofit of millions of not-so-old existing installations in homes and commercial buildings.

SUMMARY

Natural gas and propane (bottled gas) is a highly volatile and flammable substance. It is also widely distributed and used for domestic and commercial heating systems and hot water heaters. Over the years it has proved to be an efficient heating fuel which is economical, easy to distribute, clean, and relatively safe in use. Modern appliances like heating system boilers, furnaces, and hot water heaters utilize time-proven gas valve designs which depend upon the presence of a pilot light to signal that conditions are satisfactory for turning-ON the main gas burner supply thus infusing the gas burner with and abundance of gas which can serve to heat a heat exchanger or tank of water. Operation is inherently simple, and that perhaps is the essence of most of the safety intrinsic with the operation of a gas burner system. Most notably, the pilot light is "lit" and maintained in a lighted state. The flame produced by the pilot light splays about a thermocouple probe (sometimes called a thermopile, Powerpile[tm], or power generator) to produce a small direct current electric power flow having a voltage magnitude on the order of 30 to 900 millivolts. It is this small electric current which then signals the gas valve mechanism that conditions are satisfactory for operation of the main gas flow portion of the valve which feeds the main gas jets. In heating systems it is usual that a "room thermostat" or other such control device also provides a signal for the gas valve which "calls for more heat" before the main gas flow portion of the valve actually operates. There are two fundamental kinds of gas valve control setups in popular usage with heating systems, one is the so-called "self-generating" system while the other depends upon an external source of 24 volts a.c.

In the self-generating control circuit arrangment, the room thermostat is typically connected merely in series with the thermocouple wiring, and the thermocouple (e.g., thermopile) is designed to produce about 750 millivolts which flows through the thermostat control circuit hookup. In this arrangement, a closed thermostat contact set signals that the main gas valve portion may "open" (and allow gas to flow to the main jets) because the 750 millivolt electric signal is "self-generated" and therefore self-interlocking merely by the presence of the pilot light flame heating the thermocouple. A valve operating in this manner is typified by the Honeywell model VS820A1054 or Robertshaw model 700–506, when used with a Dayton type 2E466 or equivalent 750-millivolt power generator (thermocouple) cartridge.

In the other usual kind of arrangement, low voltage power customarily on the order of 24 volts a.c. is delivered from the power line by way of a small step-down transformer. The 24 volt a.c. power is seriately coupled through the room thermostat with a solenoid portion of the gas valve (such as the Honeywell model V800A1476 or Robertshaw model 700–400) which serves to actuate the main gas flow portion of the valve when the thermostat contacts are closed and 24 volts a.c. appears across the valve's electrical connections. In this arrangement the small d.c. level produced by the thermocouple is utilized to provide primary control of the main gas valve and safety interlocking is provided in that if no thermocouple signal is delivered to the valve, the unsatisfied interlock condition simply overrides the valve opening effect which might be introduced by any signal delivered by the thermostat, and burner operation can not occur. This is the safety condition in the event that the pilot light is not lit.

Gas water heaters include burners that operate in a similar manner, with a thermocouple probe that is heated by the pilot light flame serving to produce an electric signal of about 30 millivolts which serves to enable the associated gas valve to operate when the water heater tank temperature is below a desired temperature level. It is also commonplace water heater manufacturing practice in some popular brands of water heaters, such as those sold by Sears Roebuck Co., that the pilot light and thermocouple is mounted about an inch above the burner's main gas jet.

It is the primary intent of my invention to provide a teaching not only of a method but also of suitable means which can prevent the injection of massive amounts of natural gas or propane into shallow flood-water as gas bubbles which may drift about in the water, or accumulate in a confined area (such as a basement or "boiler room"), which may then lead to an unique, albeit perhaps not so rare, conditon which can cause extensive property damage through fire or explosion, and even bodily injury or death to unsuspecting occupants of a building having gas fired heating systems or hot water heating.

My teaching overcomes a shortcoming in many major gas appliances which jeopardizes the percieved safety of the natural gas or propane fueled heating system or hot water heater in millions of homes and businesses.

It is one of the important purposes of this invention to teach the gas utility distribution and gas appliance industry that an obscure and yet uniquely dangerous condition exists having consumer safety and product liability implications in the form of gas explosions or fires which may lead to massive property destruction, bodily injury or death. Through the adaptations of my invention to new gas burner designs, as well as through the retrofit of existing gas burners, such conditions can now be reduced, if not fully eliminated, as a safety problem. Mere implementation of my instant teachings both in equipment of new manufacture and through retrofit of existing systems can overcome a significant safety deficiency in most kinds of major gas appliances.

A primary purpose for my invention is to provide absolute shut-down of the main gas jets of a gas burner whenever the jets have been compromised in the sense of safe performance through the presence of shallow flood-water which has reached a critical level that may interfere with proper unimpeded operation of the main burner portion of an appliance while the water is of insufficient level to extinquish the pilot light and enable the usual safety interlock scheme which is determined by the presence or absence of the thermocouple signal which is normally produced by the pilot light heat.

Another purpose for my invention is to show how additional safety in the operation of gas burner apparatus can be obtained when the gas burner is used in a location, such as a basement, where the liklihood of partial flooding always exists. Such flooding may be the result of natural causes such as rain, or from accidental causes like that of a broken water pipe or the like.

Still another purpose for my invention is to bring forth a relatively inexpensive and reliable means, based upon the methods of my teachings, which can offer enhanced safety assurance for any kind of ordinary major gas appliance such as a heating system boiler, furnace, or hot water heater when that appliance is used in a location such as a basement where partial flooding is always present as a possible compromise to the conventional safety devices that are included in the usual gas burner arrangement.

My invention is fully taught to be implemented as an adjunct to the usual time-proven safety provisions inherent to existing gas burner apparatus, including the gas valves, thermocouple devices, and burner arrangements. As such, my invention offers considerable improvement in the overall safety of an appliance with almost negligible increase in the overall cost of that appliance in the sense of engineering expense, manufacturing procedure changes, or re-tooling costs.

DESCRIPTION OF DRAWINGS

My invention is shown in 25 figures provided on 9 sheets of drawings, including:

FIG. 22: Detail of float rod and microswitch operation.

DESCRIPTION OF MY INVENTION

Figure 1:
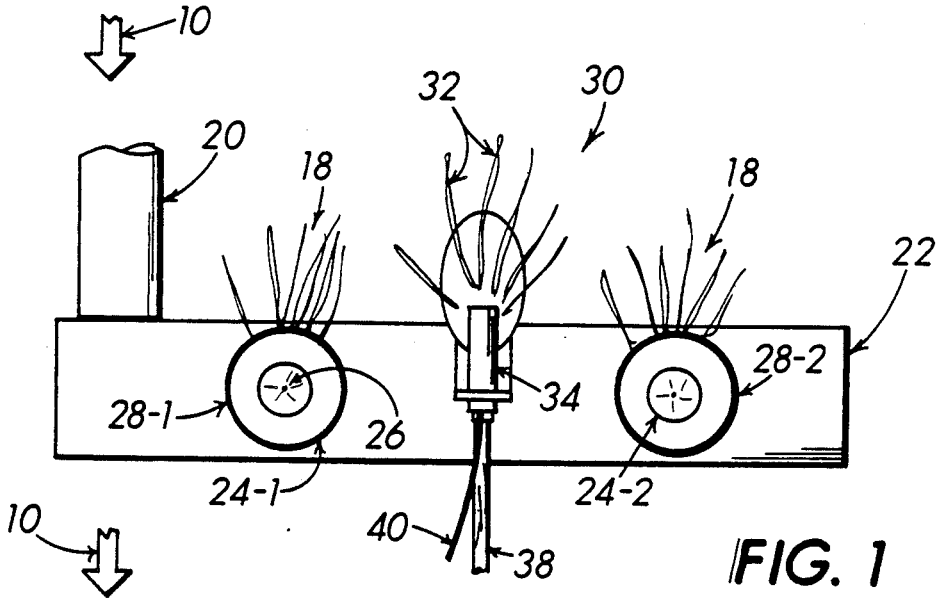
FIG. 1: Gas burner of the kind used in popular furnace designs.

A gas burner arrangement typical of many domestic heating system boilers like the model GA92-series made by Vaillant Corp., Cinnaminson, N.J. appears in FIG. 1. Gas flow 10 is provided into a feedpipe 20 that couples with a manifold 22 which serves to distribute the gas to a set of main gas jet nozzles 24-1, 24-2 each of which include a minute aperture 26 that allows a steady stream of gas to flow forth filling the burner tubes 28-1, 28-2 each of which also has an arrangement of apertures pierced through its uppermost surface allowing a main burner flame 18 to form. In usual operation a pilot assembly 30 is fed a small flow of gas through tube 38 which then produces a small confined flame 32 that serves to ignite the main burner flame. A thermocouple element 34 is also located in close proximity with the pilot flame and is heated by the pilot, producing a small electric signal on the lead 40. It shall be understood that as is usual and well known practice, the pilot light is first lit, which then heats the thermocouple, and subsequently the thermocouple signal will enable the main gas valve to be operable providing gas 10 to the main jets 24-1, 24-2. If the pilot light is unlit, the main gas can not flow. The fundamental purpose of this kind of safety arrangement is to assure that large amounts of gas provided by the main jets will not be admitted into the burner unless the pilot light is available to properly and immediately ignite the gas provided by the main gas valve.

Figure 2A:
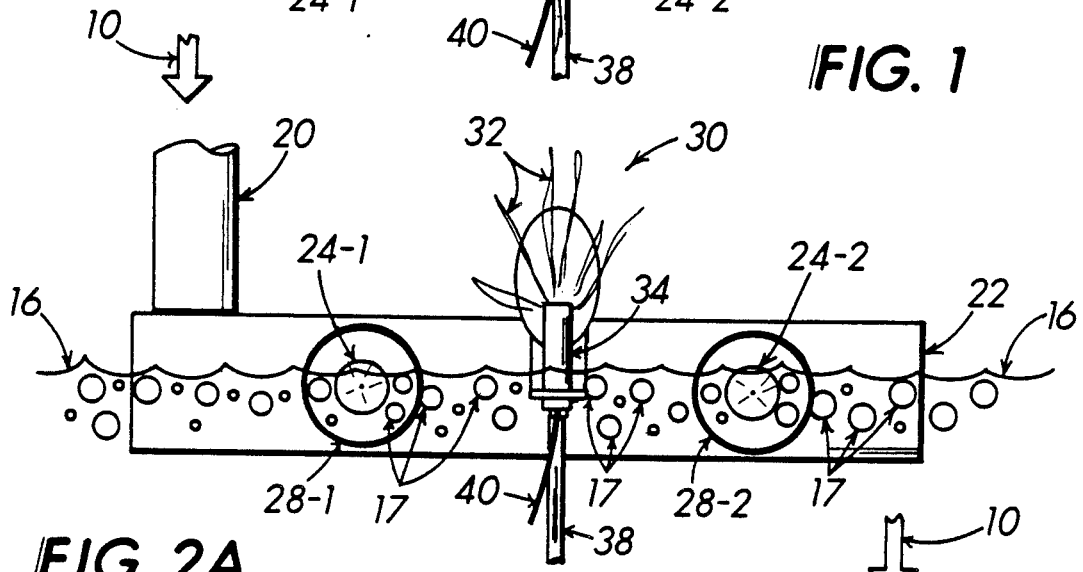
FIG. 2A: Furnace gas burner main gas jets flooded by water and injecting gas bubbles into the water.
Figure 2B:
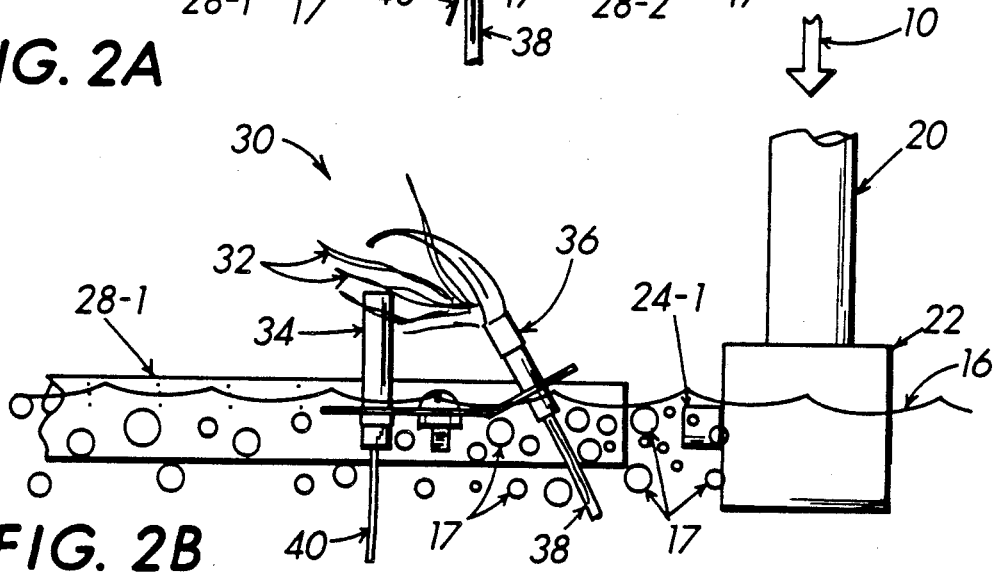
FIG. 2B: Pilot light and thermocouple operating while main gas jets are flooded and inject gas bubbles into water.

Under a condition of flooding of the burner by water 16 as shown in FIG. 2-A, a false safety interlock condition may occur which can lead to improper and dangerous operation of the burner. Most notably the condition occurs when the water level has reached a critical level that is high enough to flood over and obstruct the main gas jets 24-1, 24-2 and yet not sufficiently high so-as to extinguish the pilot flame 32. What now occurs is that the main gas jets may be turned-ON because the thermocouple 34 produces a "normal" signal, while in reality conditions are abnormal and unsafe. When the gas jets turn-ON massive amounts of gas is injected directly into the surrounding floodwater as bubbles (much like "blowing bubbles" through a soda straw) and they will float about uncontrollably as I depict in the figure by the "circles" (i.e., globules) in the water. In another view of this malfunctioning situation as shown by FIG. 2-B, you may again see how the pilot flame 32 splays about the thermocouple 34 keeping it heated and producing a "false" safe condition signal, while the bubbles of gas float about in the water. The situation where bubbles in the water are present may be worsened when there is also some motion, or water current present in the floodwater becaue the bubbles will then spread about and away from the burner before they surface causing a much more widespread danger. Surface tension of the water may also exacerbate the propensity for bubbles to form and remain unsurfaced for a longer time. Water contaminated by soap may establish such a condition, and since washing machines are often located in the vicinity of heating system equipment, it is quite likely that spilled soap may in fact contaminate the water.

Figure 3:
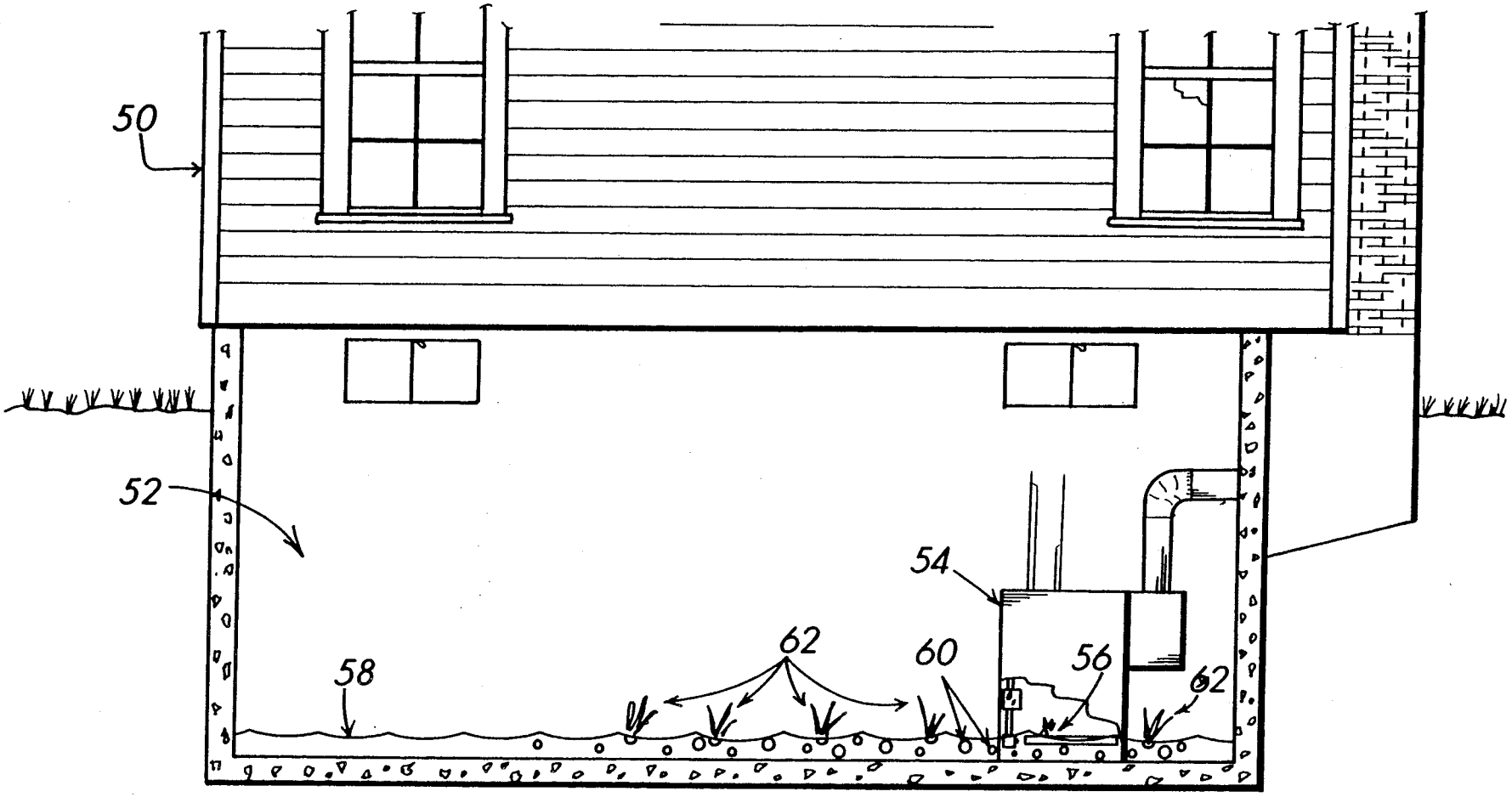
FIG. 3: Building with flooded basement shown to have gas bubbles in water which are drifting about and burning.

In FIG. 3 I depict a building 50 having a typical basement arrangement 52 that contains a gas-fired boiler 54 which includes a burner arrangement like that of FIG. 1. I also show that the basement is flooded 58 to a critical level depth of several inches, which is just sufficient to introduce the conditions discussed in relation with FIG. 2-A. I also show how the gas bubbles may spread around the basement, causing spot fires 62 as they rise to the surface of the water and burst. This is a condition which I have observed to have taken place, wherein the boiler 54 was damaged requiring replacement of the gas valve and most of the wiring. In addition, a cardboard box several feet from the boiler was set afire by the "burning bubbles".

Figures 4, 5, 6:
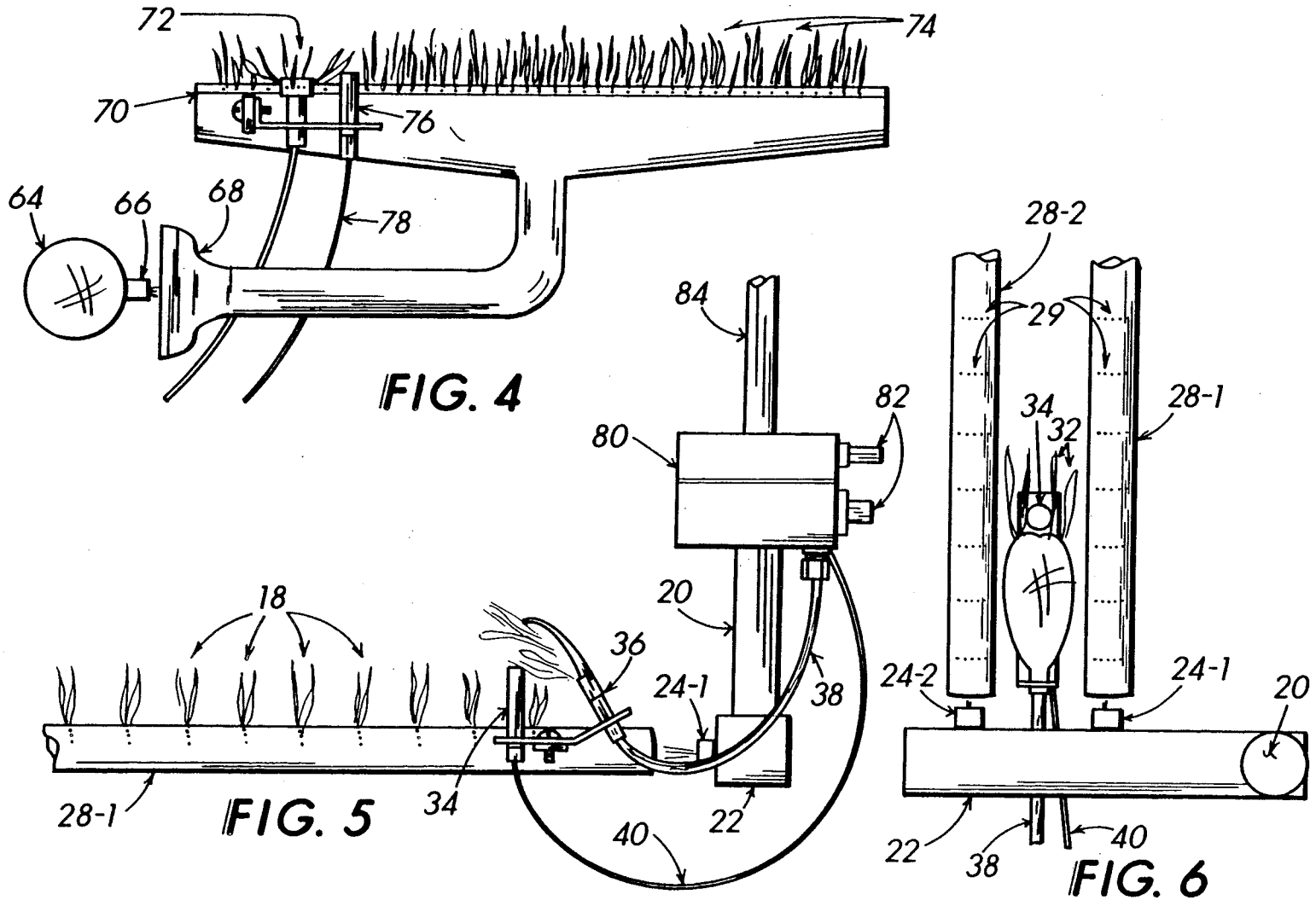
FIG. 4: Arrangement of pilot light with a common form of cast iron burner.
FIG. 5: Orientation of gas valve in relation to burner.
FIG. 6: Overhead view of burner like that of FIG. 1.

Now in FIG. 4 I illustrate another style of popular gas burner such as frequently used in heating system boilers, such as the model 235AAW007112 made by Bryant Div., Carrier Corp., Indianapolis, Ind. A similar burner variation also sometimes appears in water heaters, like the model GXF-4435 made by Mor-Flo Industries Inc., Johnson City, Tenn. A gas manifold 64 feeds a gas jet nozzle 66 that emits a stream of gas into the open bell-shaped end 68 of the main burner assembly 70 supply tube. Gas which flows from openings in the upper surface of the (cast iron or sometimes sheet-metal) burner 70 is normally lit by the pilot flame 72 to produce the main burner flames 74. As in previous example, a thermocouple 76 is situated to be heated by the pilot flame 72 and produce a signal on the output lead 78 which indicates that the pilot operation is okay, thereby enabling operation of the main gas valve.

In FIG. 5 I show the burner of the kind used in many domestic and commercial appliances such as boilers and furnaces, including the orientation of the main gas valve 80 almost immediately over the manifold 22 which results in substantial damage to the main valve controls 82 and other parts in event that the failure condition described for FIG. 2-A or FIG. 3 occurs.

In FIG. 6 I show the arrangement of the burner tubes 28-2 having a succession of apertures 29 through their upper surface which serves to support the main burner flame, as shown for FIG. 1.

Figure 7:
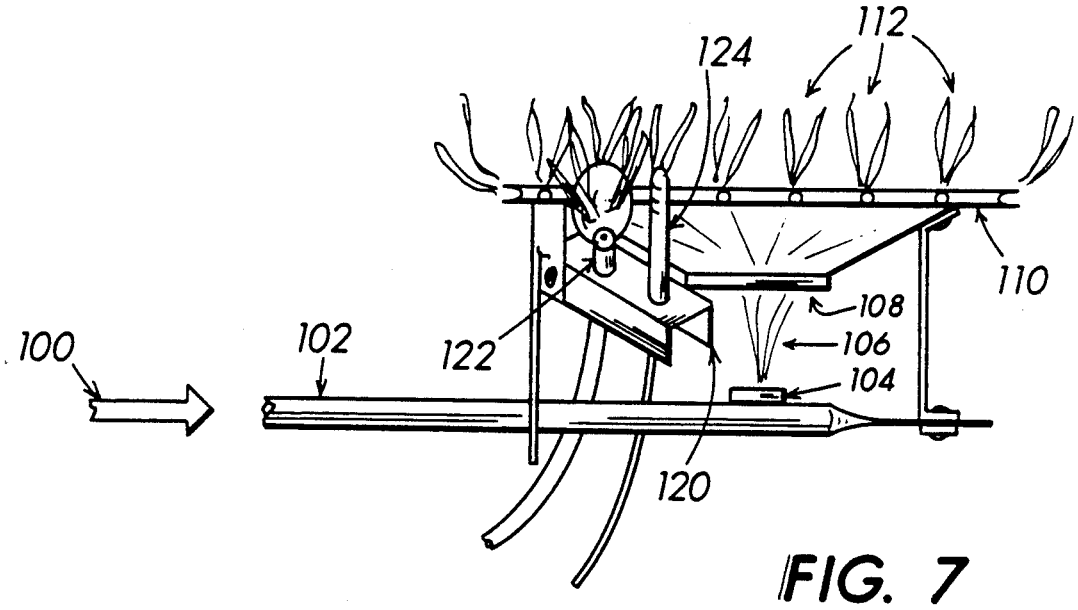
FIG. 7: Hot water heater gas burner arrangement.
Figure 8:
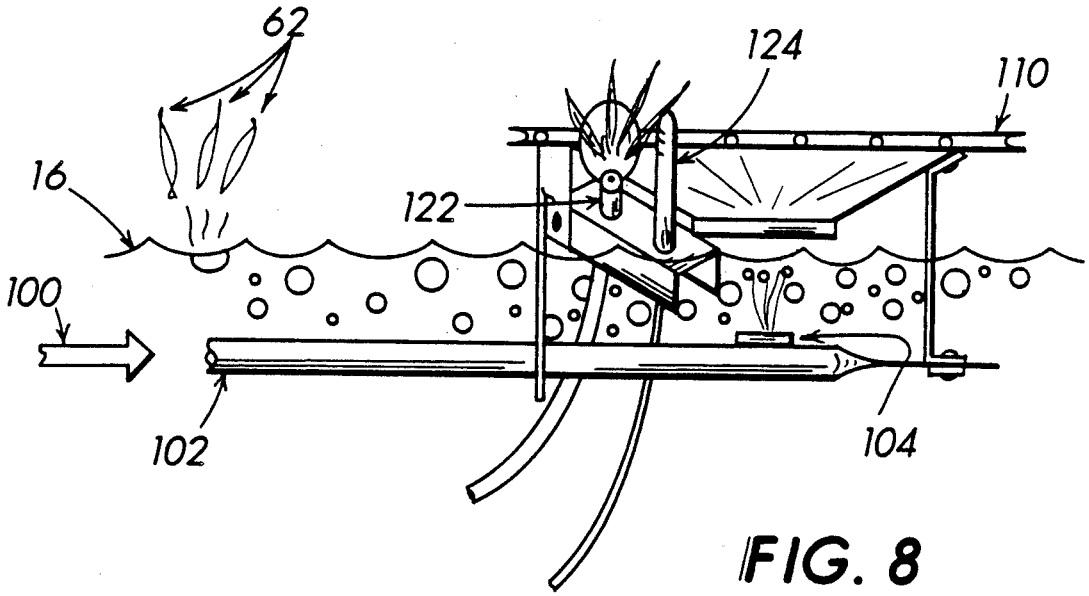
FIG. 8: Flooded hot water heater gas burner arrangement.

Gas hot water heaters, such as a Sears Roebuck (Kenmore) model 153.334420, have burners which are generally similar to the arrangement shown in FIG. 7. Gas flow 100 enters a manifold tube 102 which includes a gas jet nozzle 104 that emits a stream of gas 106 to be drawn-up 108 by draft into the main burner 110, producing gas fueled flames 112 from gas released through a series of apertures about the perimeter of the burner plate. You will also find a pilot light 122 serving to produce a small flame which ignites the main burner portion and also the pilot flame heats a thermocouple 124, producing a small signal (typically about 30 millivolts) which connects with the main gas valve and serves to interlock the gas flow dependent upon presence of the pilot light. You should also see that the pilot light 122 and the thermocouple 124 are situated about one inch above the main gas jet 104. What is now allowed is best illustrated in FIG. 8 where floodwater 16 has risen to a critical level that is above the main gas jet, but not sufficiently high so that it extinguishes the pilot 122 flame. Under this condition, the thermocouple produces a "safe" signal, while in reality the safety provisions of the burner are violated and the main gas jet is blowing gas bubbles into the water which may float around and ignite 62 and do extensive damage to the heater or even ignite a nearby object on fire. These unconfined gas bubbles, when spread about by water current, may also lead to an accumulation of gas in a confined area such as a basement and result in a major explosion, fire, or personal injury to building occupants.

Figure 9:
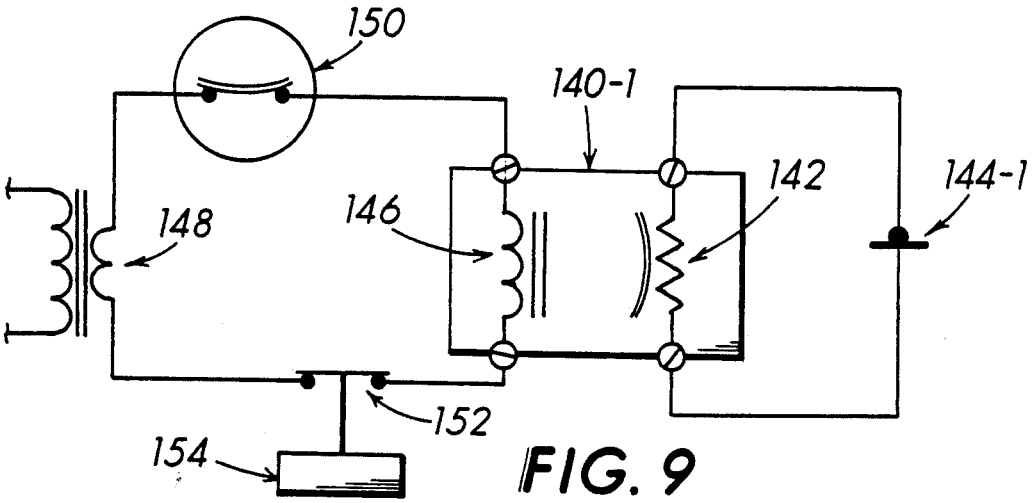
FIG. 9: Diagram of a.c. powered main gas valve circuit protected by a critical floodwater level sensor.

It is the object of my invention to thwart improper operation of the main burner of an appliance particularly when it is partially flooded to the point where the main gas jets are covered to a critical level by water, but the pilot light may still be burning normally. I have found that by an arrangement such as that of FIG. 9 can serve to stop false burner operation in a flooded area. The main gas valve 140-1 (such as a Honeywell model VR800A1400) has an interlock control portion 142 which is actuated by a small electric signal produced by the heated thermocouple 144 (like element 34 of FIG. 1). In addition, a source of low voltage (usually about 24 volts a.c.) is delivered from the main a.c. line by transformer 148 and is coupled serially through a (room) thermostat 150 like a Honeywell-Tradeline model T87F2873 to operate a solenoid (electromagnet) actuator in the valve 140-1 when the circuit from the transformer is completed through a set of closed switch contacts 152 which are controlled by a float device 154.

Figure 10:
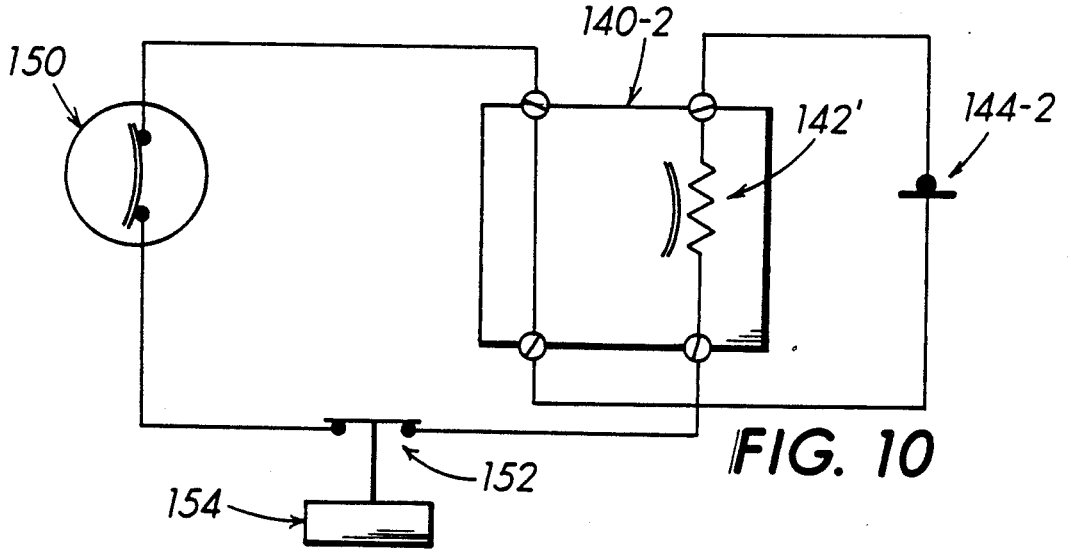
FIG. 10: Diagram of self-powered main gas valve circuit protected by critical floodwater level sensor.

When a "self generating" hookup is used as shown in FIG. 10, it is usual that a thermocouple (viz power generator or thermopile) 144 produces about 750 millivolts which couples through the main gas valve 140-2 control device 142' (commonly a bimetal actuator) and then obtains a further seriate circuit hookup with the room thermostat 150 and the float switch closed contact set 152. When the thermostat contacts are closed, and the thermocouple 144-2 is heated by the pilot light, the main gas valve is allowed to turn-ON.

Figure 11:
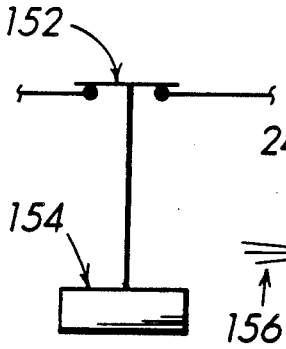
FIG. 11: Unflooded critical level floodwater sensor.
Figure 11:
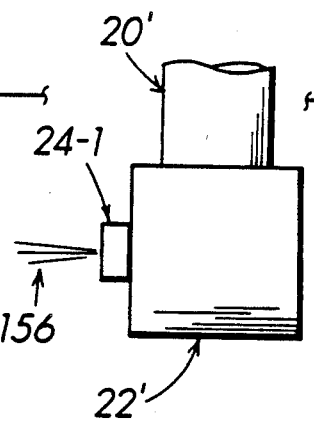
Figure 12:
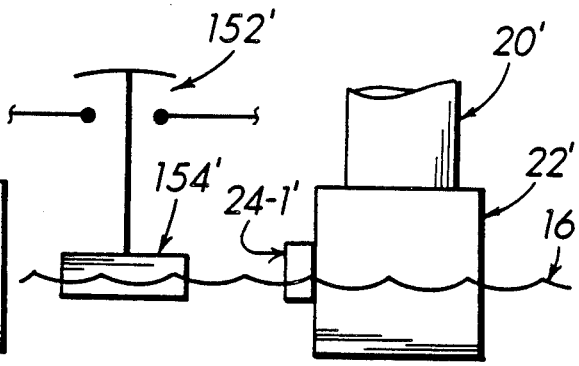
FIG. 12: Flooded critical level floodwater sensor.

FIG. 11 depicts the preferred mounting relationship which should be established between the float 154 and the gas jet 24-1' which emits the gas stream 156 when the burner assembly is NOT flooded. When flooding occurs, as now shown by FIG. 12 the rising water level 16 causes the float 154' to rise, thereby opening the contact set 152' at a critical level well before the main gas jet 24-1' is impeded by water. Although the pilot flame is still burning and the thermocouple 144-1 signals that conditions are safe, the sensor function provided by the float switch continues to disable the main gas valve.

Figures 13, 14, 15, 16A, 16B:
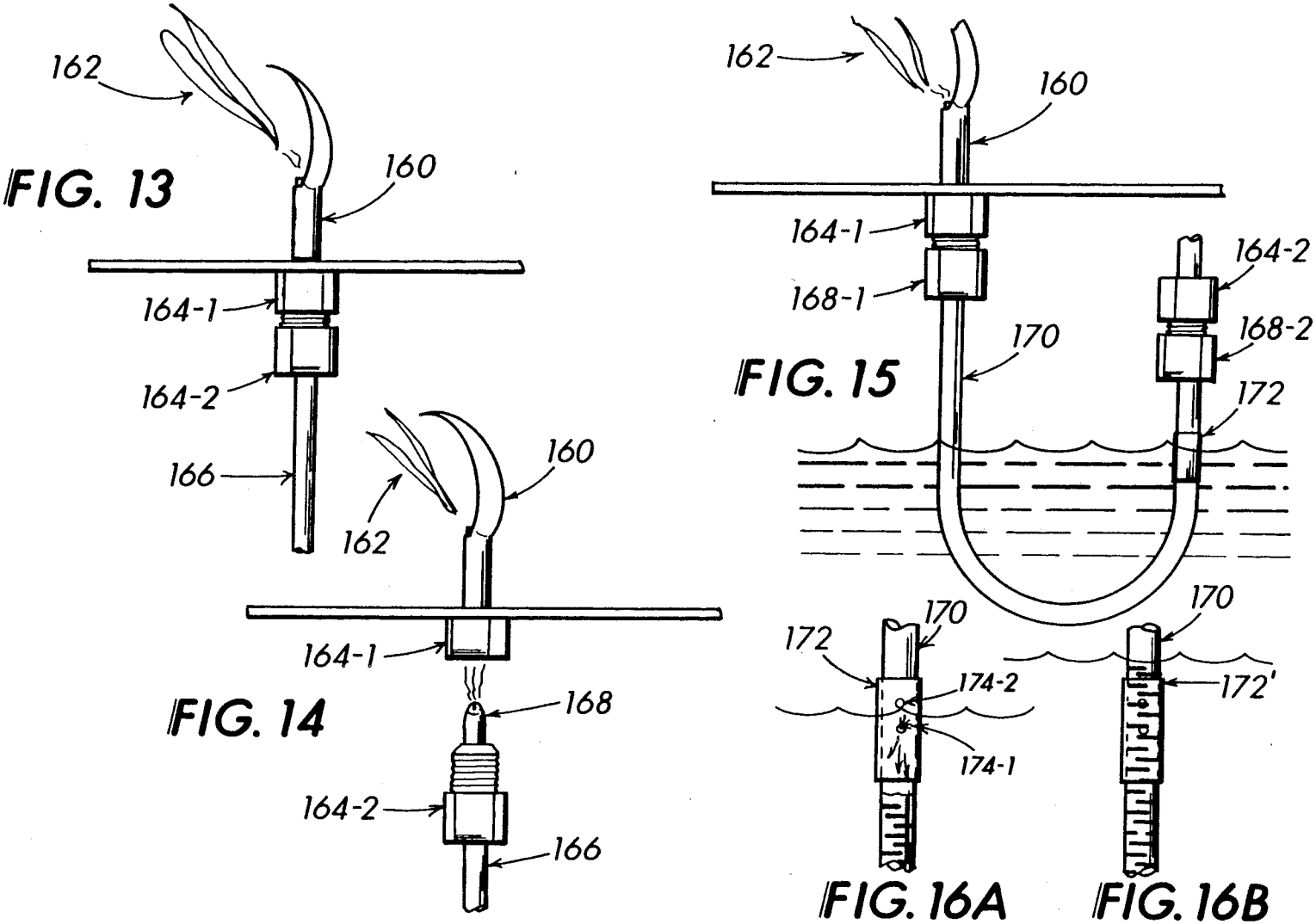
FIG. 13: Detail of a pilot light burner.
FIG. 14: Detail of gas orfice portion of pilot light burner.
FIG. 15: My invention shown as a "U" shaped device coupled between the gas orfice and the pilot light burner head.
FIG. 16A: Detail of membrane covered aperture used with my invention.
FIG. 16B: Detail of more deeply flooded arrangement of FIG. 16A.

A conventional pilot light head 160 producing a pilot flame 162 is shown in FIG. 13 to include a supply pipe 166 attached by fittings 164-1, 164-2. Upon further investigation, you will find that separation of the fittings as shown in FIG. 14 will reveal a small gas jet 168 formed into the end of the tube 166. This arrangement is typical of water heaters, but also may be found on some boiler burners. What I have now devised as a pilot extinguishing device is shown in FIG. 15 where an extension tube shaped like the letter "U" is coupled between the fittings 164-1 and 164-2. The extension tube is straight-through and unimpeded (except for its curved shape), with a water responsive device 172 affixed to it at a point well above the lowest point of the curved portion of the tube. Looking now at FIG. 16-A reveals that the tube 170 is pierced with at least one but preferably two apertures 174-1, 174-2 which are snugly covered with a material which restricts gas flow (leakage) when the covering is dry. For example, certain kinds of paper have been found suitable (although a person skilled in the art of membrane-technology can be expected to select a more commercially suitable and intrinsicly reliable choice). When flooding occurs, and the membrane is at least partly submerged its material is selected to admit a goodly amount of water through at least the aperture 174-1, thereby flooding the tube 170. Under this condition, the path of least resistance for gas flow becomes the upper opening 174-2 and the pilot is starved for gas and extinguishes, thereby shutting the whole gas system down. The choice of the membrane material is important, in that it should be sufficiently impervious to gas flow when dry to restrict excessive leakage, while at the same time it should be able to change its characteristics and admit water when flooded as well as be able to allow some gas flow (from the upper aperture 174-2). I have found that a material which swells-up (e.g., expands) serves well and perhaps that is why a collar of ordinary kraft paper works for at least demonstrative purposes.

Figure 17:
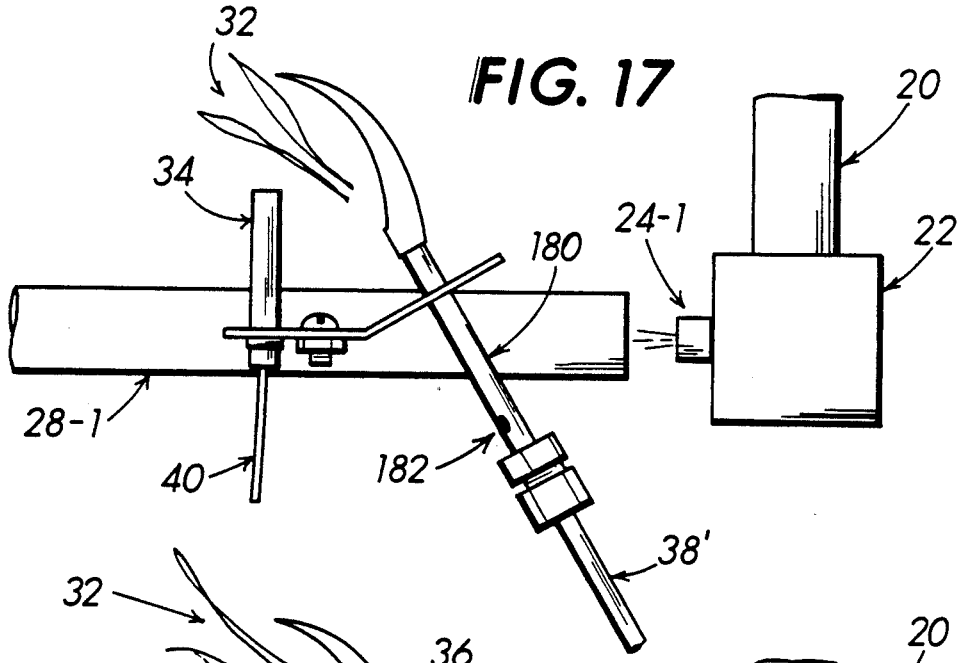
FIG. 17: Extended pilot light burner as a mode for practice of my invention.

The pilot light may also be snuffed out by rising floodwater before the water level reaches the gas jet 24-1 in the arrangement of FIG. 17 through the use of a unique pilot light burner assembly 180 which is elongated from that taught by the pilot burner 34 of FIG. 5. In my improved pilot light burner, pilot gas is provided through tube 38' and fed into the base of the pilot burner 180. A small aperture 182 is provided near the base which normally admits air while the gas rushes up the length of the burner tube, producing a flame 32 at the head-end which heats the thermocouple 34 and may ignite any main burner gas provided through the openings in the burner tube 28-1. When the burner becomes partially flooded, water may rise to the level of the aperture 182 where it then is admitted into and ultimately floods and snuffs-out the pilot flame 32 thus causing the thermocouple to cool resulting in disablement of the main gas valve. This arrangement of a self-snuffing pilot light burner assembly which has the intended purpose for extinguishing the pilot light flame in presence of a critical level of partial flooding of a gas burner is advantageous in that it can be implemented as an inexpensive and easy-to-install retrofit into existing gas burners of all types.

Figure 18:
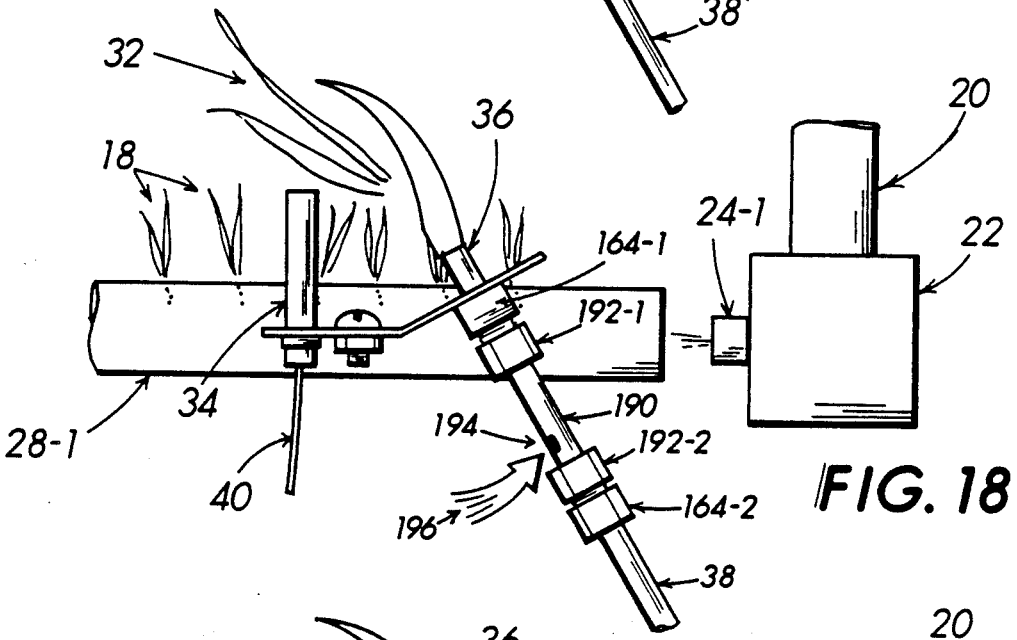
FIG. 18: Extension tube as a mode for practice of my invention.
Figure 19:
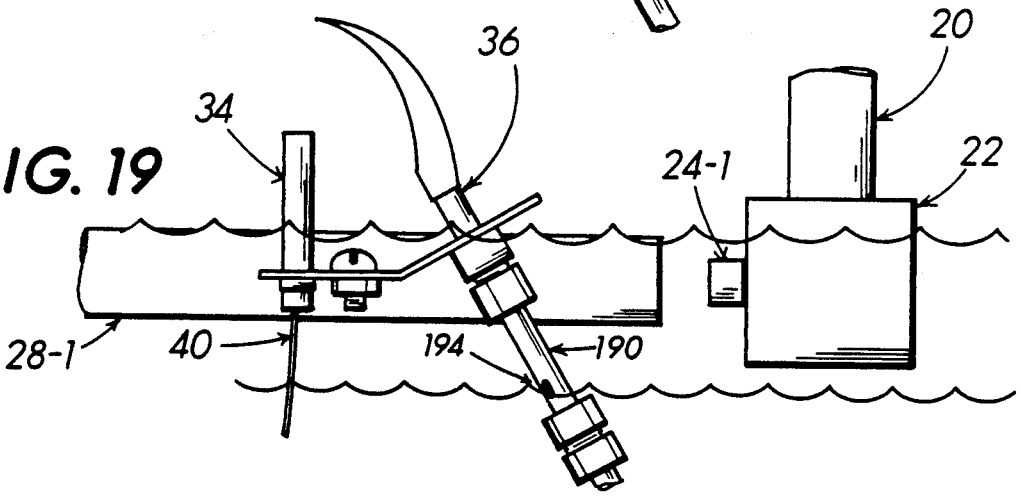
FIG. 19: Invention configuration like that of FIG. 18 shown with critical level of flooding.

Retrofit of existing pilot light burners can quickly and cheaply be obtained by my device shown in FIG. 18 in which the pilot burner 36 includes a gas supply tube 38 which originally had a fitting 164-2 that coupled with the burner fitting 164-1 like earlier shown in FIG. 13. I have separated the fittings and inserted a short tube 190 having a length of about two inches, with about ¼-inch inside diameter. The tube has an arrangement of fittings 192-1 and 192-2 which mate with fittings 164-1 and 164-2 respectively. A small (round or elongated) aperture 194 is provided through which a draft of air 196 may flow when the burner 36 is operative with the flames 32 serving to heat the thermocouple 34. When any flooding water reaches a critical level 198-1 as depicted in FIG. 19, water admits through the aperture 194 and blocks, chokes-off, or interferes with pilot gas flow thereby extinguishing the pilot flame, allowing thermocouple 34 to cool which results in a "non-signal" state from the thermocouple which immediately disables the main gas valve thereby preventing the possibility for dangerous infusion of gas into the water when the water level 198-2 increases above that of the gas jet 24-1. You shall realize that an aperture means other than that illustratively depicted will be clearly equivalent so long as it satisfies the objective of admitting water into the pilot light burner when the floodwater reaches the critical level and thereby chokes-off sufficient gas flow to maintain the pilot light flame.

Figures 20, 21, 22, 23:
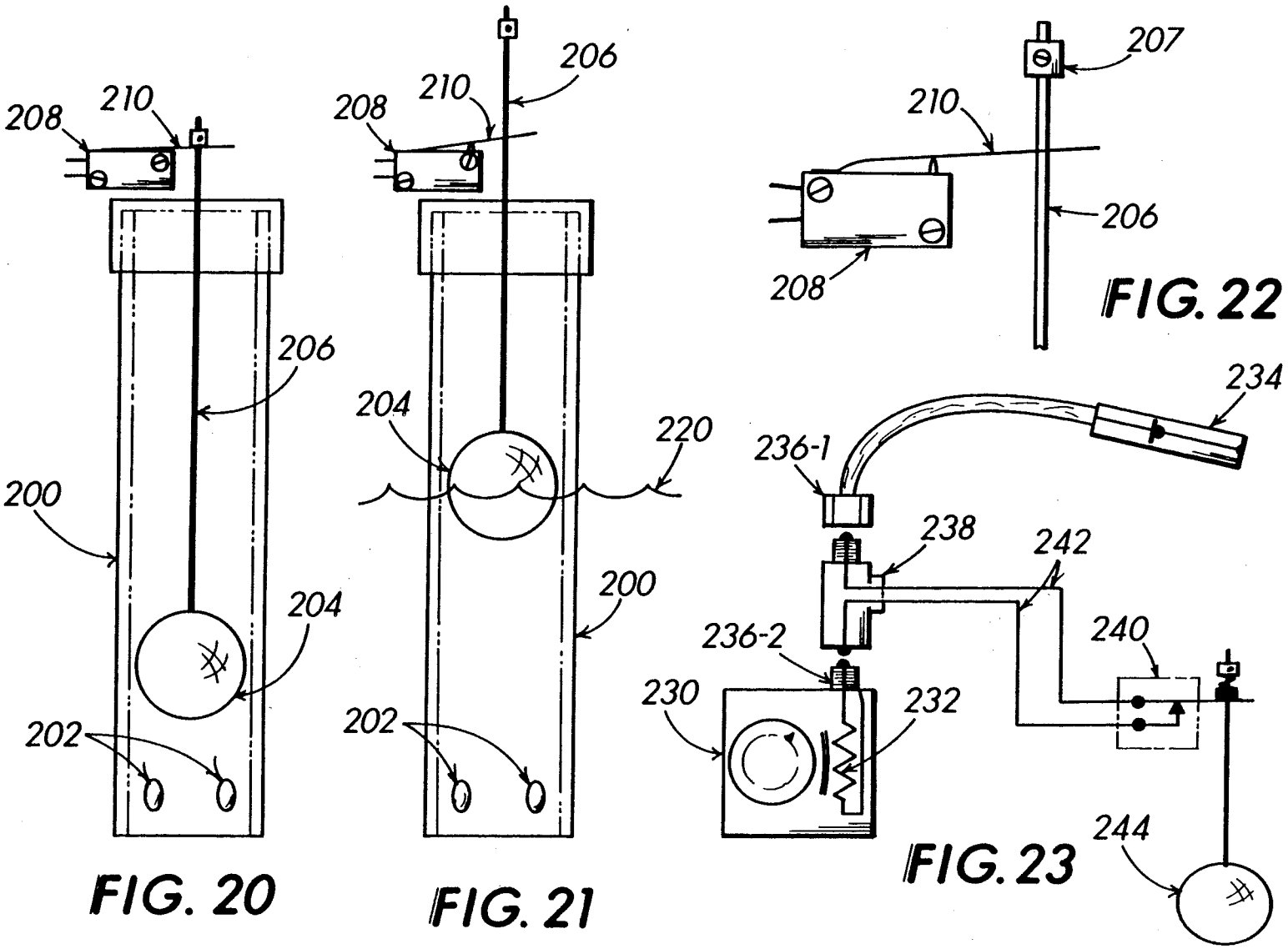
FIG. 20: Float operated adapter suited for responding to critical level of water.
FIG. 22: Float operated adapter actuated by critical floodwater level.
FIG. 23: Electrical hookup of float-operated safety device with ordinary water heater thermostat and thermocouple.

Now in FIG. 20 I show a critical level sensor which can be used to shut-off a water heater or other gas appliance in the presence of floodwater. The sensor includes a tubular housing 200 which I have modelled from a section of common 1½" PVC plastic drain pipe, into which I have bored several apertures (drilled holes) 202. A spherical float 204 attaches with a rod 206 and the control arm 210 of a leaf switch (e.g., a Microswitch [tm]) 208. The float and rod are of common construction like the float and rod assembly of a toilet water level valve control mechanismn. As the water 220 rises to (or above) the critical level as shown in FIG. 21, the float 204 rises in the tube 200 with the result that the rod extension 206 allows the microswitch arm 210 to relax, changing the positional relationship of the electrical contacts making up the leaf switch 208. How the rod extension 206 and the leaf switch 208 arm 210 interact is better shown in FIG. 22. An adjustable stop 207, such as a moveable collar, is useful for setting the critical level point where switching occurs.

Figure 24:
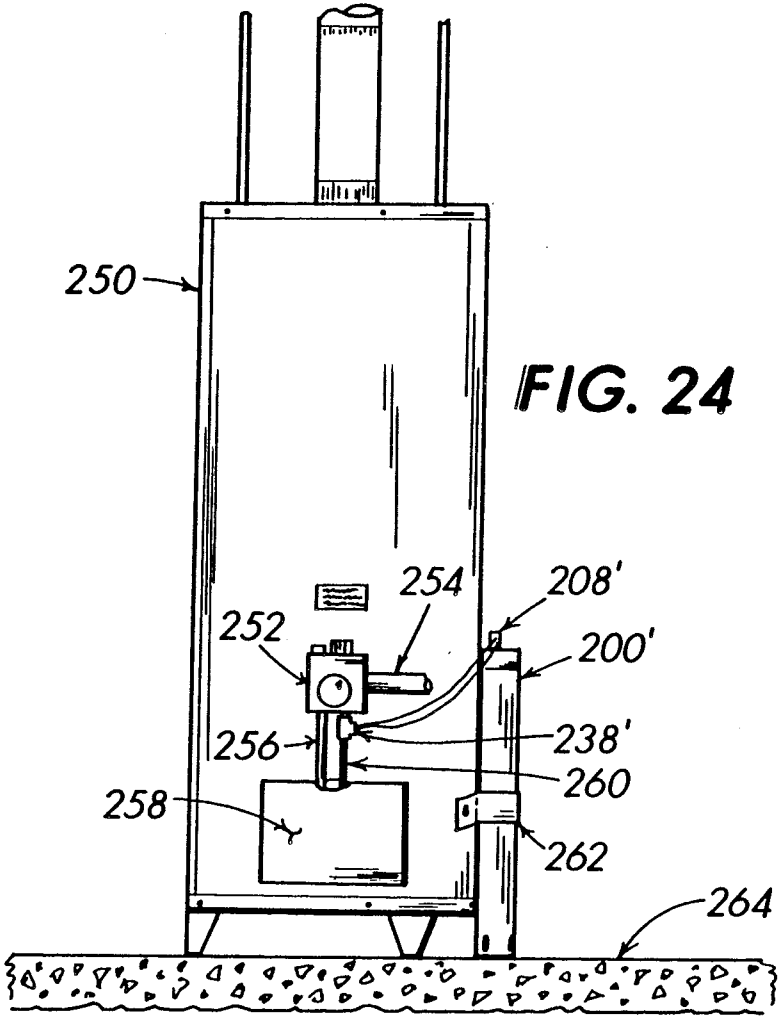
FIG. 24: Attachment of safety critical level sensor to ordinary water heater.

A thermostat 230 of the kind commonly used on gas water heaters (say a Robertshaw model 110-202) is shown in FIG. 23 to operate with a (30 millivolt) thermocouple 234 which ordinarily obtains coupling between the juncture fitting 236-1 directly with the thermostat fitting 236-2. With my safety device invention included, a tee 238 couples between the fittings 236-1, 236-2 which affords the series attachment of the leaf switch contacts 240 by leads 242 with the usual electric circuit between the thermocouple and the valve operator. Normally, the switch 240 contacts are closed and the hot water heater control operates as usual. When any surrounding flood water rises, a critical level is reached where float 244 rises sufficiently to allow the contact set of switch 240 to open, thereby interrupting operation of the gas valve 230 and extinguishing the pilot light. You might attach my invention as an after-market installed safety device like now appears in FIG. 24. The tubular device 200' is held upright and against the side of a hot water heater 250 with a clamp 262. Usually the bottom of the device may rest on the floor 264. A thermostat 252 which is supplied gas 254 from the gas main includes a main gas jet supply line 256 which feeds the burner which is located together with a pilot light and thermocouple behind an access cover 258. A tee 238' hooks between the thermocouple line 260 and the mating thermostat connection. As floodwater rises, reaching the critical level, the water heater 250 is fully shut-down by the opening of the contact set provided in the leaf switch 208'. Any person skilled in the art can now see how this device, either as made as described, or of an equivalent construction which produces the same results, may provide a considerable reduction in the liklihood of explosion or fire in event of water heater flooding.

Figure 25:
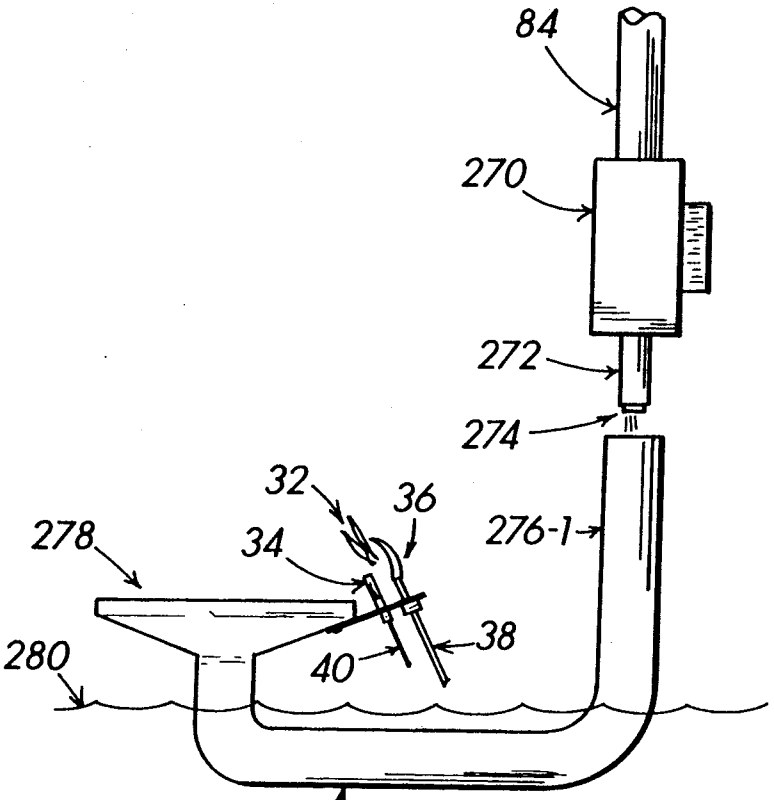
FIG. 25: Critical level of floodwater relative with burner having elevated main gas jet location.

A special sort of burner is shown in FIG. 25 where a thermostat 270 is provided with a short outlet extension tube 272 which supports the main gas jet 274 well above the level of the thermocouple 34 and the pilot light 36. The main gas jet 274 produces a flow of gas which is received by the manifold tube 276-1 and drawn up (by draft) to the burner plate 278 where the heating flames are produced. In the presence of floodwater 280 reaching a critical level, the lower portion of the manifold tube 276-2 is choked with water and draft can not occur. As such, the main gas jet 274 is likely to release a large amount of gas directly into the area surrounding the burner, because the thermocouple and pilot light continue to operate normally. Under such circumstance, explosion or fire may follow the filling of any surrounding area with gas fumes. Drafted gas flow, where the main gas jet is above the main burner flame level occurs in some styles of hot-air furnaces and has also been seen in water heater designs (notably, like that of American Appliance Mfg. Co., Santa Monica, Calif.). You will quickly realize that a protective device like that described in conjunction with FIG. 24 can serve to protect this style of burner as well as that of the earlier described configurations.

I have taught my invention to show a method for obtaining improved safety of operation from many categories of gas burner apparatus. I have also shown several forms of devices which can serve to obtain the safety related operational results desired by my methods. You shall realize however that these several implementations are taught merely for purpose of illustrative example, and a person skilled in the art may reasonably be expected to come forth with numerous devices which obtain the same effective results which are now provided by my showings. These obvious variations on my teaching shall not detract from the unique character of my invention: that being a method for obtaining safe operation of a gas appliance through disabling the operation of the main gas jets of the appliance's gas burner when the burner is partially submerged in floodwater to the extent that a critical level is reached where free flow of gas issued from the main gas jets is impeded by the water, while the pilot flame remains lit.

I have taught my invention as an adjunct to existing gas fired burners in the form of an adapter or accessory, while at the same time I have with every intent also taught the invention as a device suitable for inclusion in new appliances which use gas burners of conventional configuration. My embodiments such as taught for FIGS. 15, 18, 20, and 24 particularly show my invention as an "adapter" or conversion suitable for use with gas burners of existing design; however, the essential methodology inherent in these particular teachings shall be considered as a mere obvious variation if it is included in gas burner apparatus of new design without certain interface detail such as (but of course not solely limited to) fittings 164-1, 164-2, 168-1, 198-1, 192-2 and the specific form of the embodiment, such as for example that generalized by element 200 in FIG. 20. Any person having skill in the art may also be expected to make substantial changes in the manner of implementation, choices of materials or details of configuration, and even functional detail which merely derive from general engineering choices and considerations without departing from the essence of my invention.

What I claim is:

1. Safety method for gas burner apparatus having a pilot light means and a thermocouple means mounted at a level substantially above the level of gas flow path path produced by any main gas jet means whereby the main gas jet means is protected from improperly injecting gas into any surrounding environment when the burner apparatus is partially flooded by water through the steps of:

predetermining a critical level for any condition of water flooding where the water level is sufficient to interfere with the gas flow path produced by the main gas jet means while the water level is substantially less than a level where it may extinguish the pilot light flame;

sensing the presence of any surrounding floodwater level when it has reached at least the predetermined critical level; and, stopping any flow of gas to the main jet means when at least the critical level of floodwater has been sensed.

2. Method of claim 1 comprising the further steps of:

inhibiting normal pilot light gas flow when such critical level has been sensed;

snuffing out the pilot light as the result of the inhibited gas flow; and, utilizing a signal condition produced by the thermocouple means in response to the snuffed out state of the pilot light flame to stop further gas flow to the main gas jet means.

3. Method of claim 1 comprising the further steps of:

producing an electrical signal having a usual value between about 30 and 900 millivolts from the output terminal means of the thermocouple means when it is heated by the pilot light;

utilizing the electrical signal to enable main gas jet flow through an electrically operable gas valve means; and, interrupting the coupling of the electrical signal between the thermocouple means and the gas valve means when the critical level of any surrounding floodwater is sensed.

4. Method of claim 1 comprising the further steps of:

producing an electrical signal from the output terminal means of the thermocouple means when it is heated by the pilot light;

utilizing the electrical signal to enable an electrically controlled portion of a main gas valve means and provide gas flow to the main jet means;

inhibiting gas flow to the pilot light means when the critical level of any surrounding floodwater is sensed thereby extinquishing the pilot light; and, allowing the thermocouple means to cool in the absence of heat being provided by the pilot light, whereupon the electrical signal is no longer produced and the gas valve means is effectively disabled thereby stopping gas flow to the main gas jet means.

5. Method of claim 4 comprising the further steps of:

providing the pilot light means with an orficwe which is situated substantially below the critical level;

providing the pilot light means with a flame producing head situated substantially above the critical level;

coupling the orfice and the head with a length of tubing;

piercing the tubing with a minute aperture at a position about that of the critical level;

admitting water through the minute aperture when the surrounding floodwater reaches the critical level;

spoiling the coupling of pilot light gas between the orfice and the head by the presence of water admitted through the aperture; and, extinquishing the pilot light flame as the result of such spoiled coupling.

6. Method of claim 4 comprising the further steps of:

providing the pilot light means with an orfice which is coupled with a flame producing head with a length of tubing;

situating at least the pilot light means substantially above the critical level;

forming the tubing into a curved and preferably "U" shaped configuration whereby the two ends of the tubing terminate substantially above the center portion of the tubing and usually at a level above the critical level;

extending at least the center portion of the tubing below the critical level;

piercing the tubing with a minute aperture at a position about that of the critical level; and, covering the aperture with a gas-resisting membrane selected to be sufficiently permeable to the presence of any flood water which may rise above the critical level to admit water through the aperture and thereby spoil the effective flow of gas between the orfice and the head with the result that the pilot light flame is extinquished.

7. Safety means for gas burner apparatus having pilot light means mounted at a level substantially above the level of a gas path produced by any main gas jet means whereby the main gas jet means is protected from improperly injecting gas into any surrounding environment and which may include any circumjacent water when the burner apparatus is partially flooded by water and therefor comprising:

means for inhibiting gas flow to the main gas jet means when the surrounding water has at least reached a predetermined critical level which is sufficient to interfere with safe operation of the gas path produced by the main gas jet means while still substantially less than a level sufficient to effectively extinquish the pilot light means.

8. Safety means of claim 7 comprising:

means for producing an electrical signal in response to heat produced by the pilot light means;

means for controlling enablement of gas flow to the main gas jet means in response to the electrical signal coupled from the producing means; and, means for interrupting the electrical signal coupled between the producing means and the flow controlling means and thereby inhibiting gas flow to the main gas jet means in response to sensing a critical level of floodwater in immediate proximity of at least a portion of the gas path comprising the main gas jet means.

9. Safety means of claim 8 and said interrupting means comprising:

electrical contact means seriately coupled between said producing means and the electrical signal responsive portion of the controlling means wherein the contact means are predetermined to be CLOSED (e.g., electrically conductive) when the surrounding water is below the critical level; and, means responsive to the critical level of any surrounding water whereby the responsive means couples with the contact means and is therewith effective for OPENing the contact means (e.g., electrically non-conductive) whenever the water level exceeds the critical level.

10. Safety means of claim 7 comprising:

means for producing an electrical signal in response to pilot light flame heat produced by the pilot light means; means for controlling the enablement of gas flowflow to the main gas jet means in response to the electrical signal coupled from the producing means; and, means for inhibiting gas flow to the pilot light means when any surrounding floodwater is sensed to have reached at least the critical level thereby extinquishing the pilot light flame which results in negligible electrical signal from the producing means and disablement of gas flow to the main gas jet means.

11. Safety means of claim 10 and said pilot light means comprising:

gas orfice means providing a minor jet of gas sufficient for operation of the pilot light flame;

pilot light burner means effective for producing the pilot light flame;

means for coupling the minor jet of gas effectively between the orfice means with the pilot light burner means comprising metal tubing means ordinarily between about 25 and 150 millimeters in length and with a diameter between about 3 and 12 millimeters and with a portion of the tubing extending substantially below the critical level; and, means for admitting a substantial portion of water into the metal tubing whenever the surrounding floodwater exceeds the critical level thereby effectively stopping any sufficient flow of gas between the orfice means and the pilot light burner means to support the pilot light flame.

12. Safety means of claim 7 comprising:

means for producing an electrical signal in response to pilot light flame heat produced by the pilot light means;

means for providing a source of low voltage a.c. power;

means for controlling the enablement of gas flow to the main jet means in response to the electrical signal coupled from the producing means and the electrical signal coupled from the a.c. power source; and, means for interrupting the electrical signal coupled between the a.c. power source and the controlling means and thereby inhibiting gas flow to the main gas jet means in response to sensing at least a critical level of flood water in immediate proximity of at least a portion of the gas flow path produced by the main gas jet means.

13. Safety means of claim 12 and said interrupting means comprising:

electrical contact means seriately coupled between said a.c. power source and the electrical signal responsive portion of the controlling means wherein the contact means are predetermined to be CLOSED (e.g., electrically conductive) when the surrounding water is below the critical level; and, means responsive to the critical level of any surrounding water whereby the responsive means couples with the contact means and is therewith effective for OPENing the contact means (e.g., electrically non-conductive) whenever the water level exceeds the critical level.

14. Safety means for gas burner apparatus effective for substantially preventing gas flow from the burner apparatus main gas jet means when any surrounding floodwater has risen to a level sufficient to interfere with the burner apparatus normal main gas flow path, comprising:

main gas jet means effective for producing the main gas flow path;

means for producing a pilot light substantially above a lowest portion of the main gas flow path produced by the main gas jet means;

means for sensing the floodwater having reached at least a critical level sufficient to interfere with the main gas flow path and substantially less than a level that will extinquish the pilot light producing means; and, means coupled with the sensing means effective for inhibiting gas flow from the main gas jet means whenever at least the critical level is reached.

15. Safety means of claim 14 comprising:

means for producing an electrical signal in response to heat produced by the pilot light means;

means for controlling the enablement of gas flow to the burner's main gas jet means in response to the electrical signal coupled from the producing means; and, means for interrupting the electrical signal coupled between the producing means and the flow controlling means in response to any sensing of the critical level of flood water thereby disabling gas flow to the main gas jet means.

16. Safety means of claim 15 and said interrupting means comprising:

means for producing switching of a set of electrical contact means coupled in series with the electrical signal;

means responsive to the floodwater level and coupled with the switching means to effectively close (bridge) the electrical contact means whenever the floodwater level is less than (below) the critical level, and to effectively open (unbridge) the electrical contact means whenever the floodwater level rises to at least a critical level.

17. Safety means of claim 14 comprising:

means for producing an electrical signal in response heat produced by a pilot light means;

source of low voltage a.c. electric power;

means for controlling the enablement of gas flow to the burner's main gas jet means in combined response to the electrical signal coupled from the producing means and a low voltage electrical signal coupled from the a.c. power source; and, means for interrupting the electrical signal coupled between at least one of the a.c. power source and the electrical signal producing means, and the flow controlling means in response to any sensing of the critical level of flood water thereby disabling gas flow to the main jet means.

18. Safety means of claim 14 comprising:

means for producing an electrical signal in response to pilot light flame heat produced by a pilot light means;

means for controlling enablement of gas flow to the burner's main gas jet means in response to the electrical signal coupled from the producing means; and, means for extinquishing the pilot light flame in response to sensed presence of the critical level of floodwater thereby effecting a negligible electrical signal from the producing means and effective disablement of gas flow to the main gas jet means.

19. Safety means of claim 18 and said pilot light means comprising:

gas orfice means providing a minor jet of gas sufficient for operation of the pilot light flame;

pilot light burner means effective for producing the pilot light flame;

means for coupling the orfice means and the pilot light burner means; and, means effective with the coupling means to impede gas flow between the orfice means and the pilot light burner means in response to the floodwater reaching the critical level and thereby extinquishing the pilot light flame.

20. Safety means of claim 14 comprising:

means for producing an electrical signal in response to pilot light flame heat produced by a pilot light means;

means for permitting enablement of gas flow to the burner's main gas jet means in response to presence of the electrical signal and denying enablement of the gas flow in absence of the electrical signal; and, means for extinquishing the pilot light flame in response to the floodwater having reached the critical level.

* * * * *